US005881950A

United States Patent [19]

Koehn

[11] Patent Number: 5,881,950

[45] Date of Patent: Mar. 16, 1999

[54] ROTARY MATERIALS ORGANIZER

[75] Inventor: Annalee Koehn, Chicago, Ill.

[73] Assignee: R. R. Donnelley & Sons Company, Downers Grove, Ill.

[21] Appl. No.: 958,580

[22] Filed: Oct. 28, 1997

[51] Int. Cl.[6] ..... B65D 5/42; A47F 5/02

[52] U.S. Cl. ..... 279/199.1; 211/131.1; 211/163; 248/131; 248/349.1

[58] Field of Search ..... 229/178, 199.1, 229/122.34; 312/249.2; 211/131.1, 163, 167; 248/131, 349.1, 346.4

[56] References Cited

U.S. PATENT DOCUMENTS

| | | | |
|---|---|---|---|
| 1,800,816 | 4/1931 | Cooley | 229/199.1 |
| 1,808,530 | 6/1931 | Cooley | 229/199.1 |
| 3,727,826 | 4/1973 | Shepherd | 229/178 |
| 4,300,691 | 11/1981 | Shemtov | 211/131.1 |
| 4,437,713 | 3/1984 | Roach | 229/178 |
| 4,463,856 | 8/1984 | Strasser | 211/163 |
| 4,700,829 | 10/1987 | Goodyear . | |
| 4,953,696 | 9/1990 | Huang et al. . | |
| 5,046,626 | 9/1991 | Hansen . | |
| 5,377,850 | 1/1995 | Liaw . | |
| 5,487,599 | 1/1996 | Weisburn et al. . | |
| 5,749,477 | 5/1998 | Chang | 211/163 |

*Primary Examiner*—Gary E. Elkins
*Attorney, Agent, or Firm*—Marshall, O'Toole, Gerstein, Murray & Borun

[57] ABSTRACT

In order to provide a sturdy yet inexpensive rotary corrugated box, the box includes a corrugated base having an upstanding corrugated side wall, each having an inner surface and an outer surface to define a box-like enclosure. A rigid insert is disposed within the box-like enclosure substantially co-extensive with the inner surface of the corrugated base. The rigid insert is substantially planar and has a flat surface in engagement with substantially the entire inner surface of the corrugated base. A rotary base assembly is provided which includes a first portion in engagement with the outer surface of the corrugated base and a second portion to be disposed on a supporting surface. The first and second portions cooperate so as to facilitate relative rotational movement therebetween. With this construction, the first portion of the rotary base assembly is rigidly secured to the rigid insert through the corrugated base to form a sandwich construction consisting of the rigid insert and the first portion of the rotary base assembly with the corrugated base therebetween.

20 Claims, 4 Drawing Sheets

ROTARY MATERIALS ORGANIZER

FIELD OF THE INVENTION

The present invention is directed to an organizer for selectively accessed materials and, more particularly, it is directed to a rotary organizer that utilizes a corrugated box construction.

BACKGROUND OF THE INVENTION

In recent years, a wide variety of different types of organizers have been developed for carrying materials that may need to be selectively accessed for use. These organizers are exemplified by Hansen U.S. Pat. No. 5,046,626 which proposes a document holder for holding magazines, brochures and other looseleaf papers in an upright position with a relatively large portion of each document being exposed to view. Another form of organizer is exemplified by Liaw U.S. Pat. No. 5,377,850 which proposes a modular stationery stand including a rotary base and various compartments for pens and the like. Still another form of organizer is exemplified by Huang et al. U.S. Pat. No. 4,953,696 which proposes a detachable stationery case rack positioned on a rotating base so that a number of stationery receiving cases may be flexibly arranged. And still another form of organizer is exemplified by Weisburn et al. U.S. Pat. No. 5,487,599 which proposes a storage cabinet for recorded media that is formed of a plurality of identical modules mounted on a rotating base. These organizers are additionally exemplified by Goodyear U.S. Pat. No. 4,700,829 which proposes an office organizer for desks having multiple compartments, trays, slots and the like. While these organizers all may be meritorious in certain respects, they are also all relatively expensive to manufacture and, thus, they are entirely unsuitable for certain applications.

In particular, there are certain applications where a rotary organizer should be highly functional in use but relatively inexpensive to manufacture. This is the case, for instance, for educational kits designed to carry and support one or more relatively heavy books, as well as other materials such as art supplies, multi-media products, and the like. For an educational kit of this type, the rotary organizer must ideally be capable of supporting considerable weight, have a presentable exterior appearance, and be compartmentable and rotatable.

While the prior art suggests that there has been a rather steady development of materials organizers, there has been no organizer that has met all criteria for an educational kit or other similar applications.

The present invention is directed to overcoming one or more of the foregoing problems and achieving one or more of the resulting objects.

SUMMARY OF THE INVENTION

It is a principal object of the present invention to provide a rotary materials organizer that is highly functional in use yet is formed of a construction that is relatively inexpensive to manufacture. It is also an object of the present invention to provide such a rotary materials organizer in the form of a corrugated box that is well suited for applications such as educational kits and the like. It is a further object of the present invention to provide a rotary materials organizer that utilizes a sandwich construction consisting of a rotary base assembly secured to a rigid box insert with a corrugated box base therebetween.

Accordingly, the present invention is directed to a rotary materials organizer comprising a corrugated base having an upstanding corrugated side wall to define a box-like enclosure. A rigid insert is disposed within the box-like enclosure substantially co-extensive with the inner surface of the corrugated base. The rigid insert is substantially planar and has a flat surface in engagement with substantially all of an inner surface of the corrugated base. The rigid insert has an outer peripheral edge substantially co-extensive with all of an inner surface of the side wall. The rotary corrugated box also includes a rotary base assembly including a first portion in engagement with an outer surface of the corrugated base. The rotary base assembly also has a second portion disposed on a supporting surface for the box-like enclosure. The rotary base assembly further includes means for facilitating relative rotational movement between the first and second base assembly portions. With this construction, the rotary corrugated box further includes means for rigidly securing the first portion of the rotary base assembly to the rigid insert through the corrugated base to form a sandwich construction consisting of the rigid insert and the first portion of the rotary base assembly with the corrugated base therebetween.

In the exemplary embodiment, the corrugated base is rectangular and the corrugated side wall includes four side wall portions. It is also advantageous for the corrugated side wall to be formed to have a double thickness of a corrugated sheet material forming the base and side wall portions. Further, the rigid insert preferably comprises plywood and the securing means comprises a plurality of screws. The first and second portions of the rotary base assembly are each advantageously formed of metal. With this construction, the means for facilitating relative rotational movement preferably comprises a plurality of ball bearings.

As for other highly advantageous features, the rotary corrugated box may include an opposed pair of elongated cutouts in the corrugated side wall for hand lifting the box. It is also advantageous, especially for an educational kit or the like, for the rotary corrugated box to include at least one upstanding corrugated divider within the box-like enclosure to form compartments therein, and for the double thickness of the corrugated side wall to be defined by an inwardly folded wall portion. Preferably, the inwardly folded wall portion has a free edge generally adjacent an upper surface of the rigid plywood insert.

Other objects, advantages and features of the present invention will become apparent from a consideration of the following specification taken in conjunction with the accompanying drawings.

DETAILED DESCRIPTION OF THE PREFERRED EMBODIMENT

Figure 1:
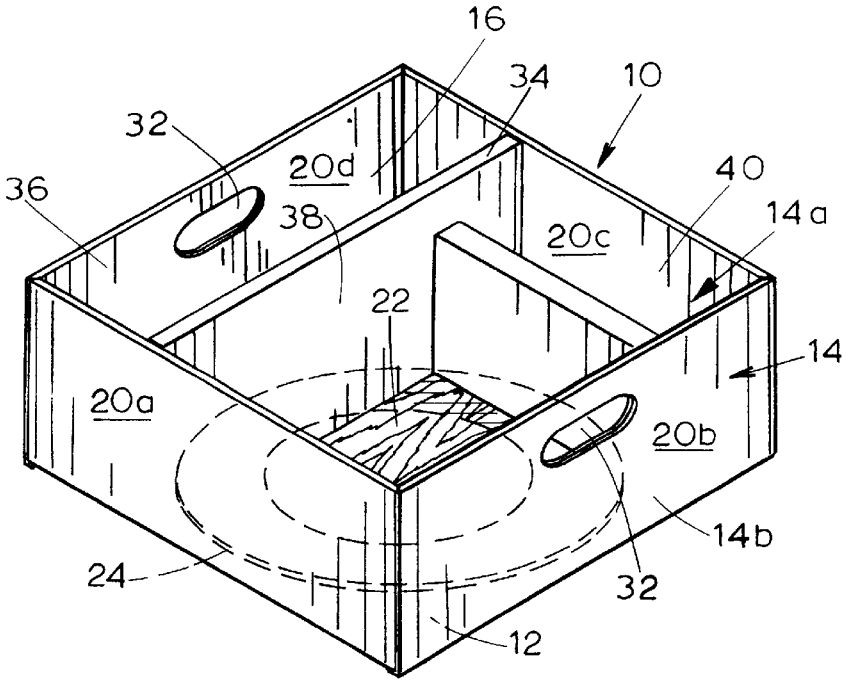
FIG. 1 is a top perspective view of a rotary corrugated box in accordance with the present invention.
Figure 2:
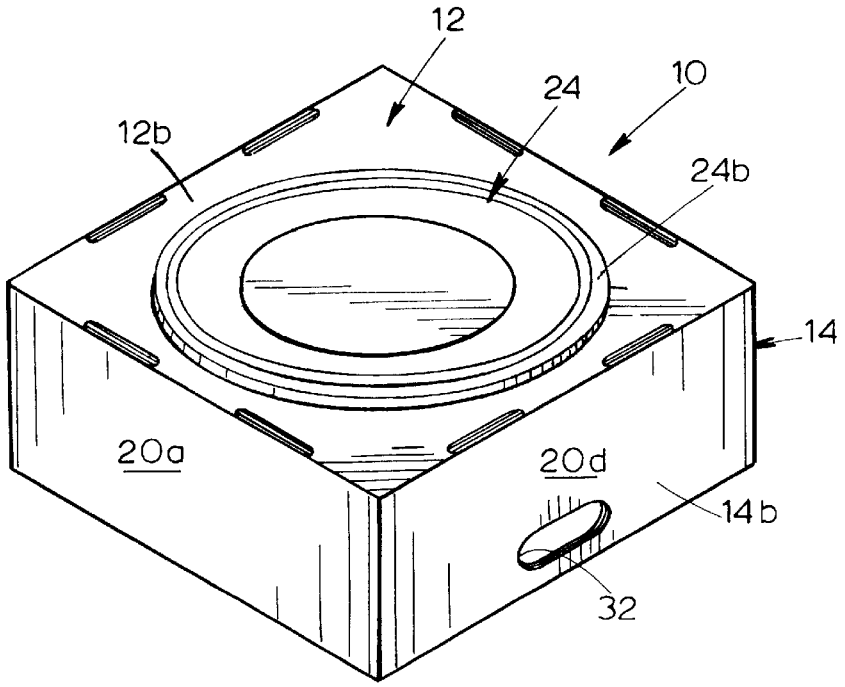
FIG. 2 is a bottom perspective view of the rotary corrugated box of FIG. 1.

In the illustrations given, and with reference first to FIG. 1, the reference numeral 10 designates generally a rotary corrugated box in accordance with the present invention which includes a corrugated base 12 having an upstanding corrugated side wall generally designated 14 to define a box-like enclosure 16. The corrugated base 12, which may advantageously be square, and the corrugated side wall 14, are preferably formed of a single sheet 18 of a corrugated material, and they each have an inner surface 12*a* and 14*a* and an outer surface 12*b* and 14*b* (see, also, FIG. 3A). With this construction, and in a particularly preferred embodiment, the rotary corrugated box 10 is preferably formed such that the corrugated side wall 14 is defined by four side wall portions 20*a*, 20*b*, 20*c*, and 20*d* each having a double thickness of the corrugated sheet material 18 (see, again, FIG. 3A).

Figure 4:
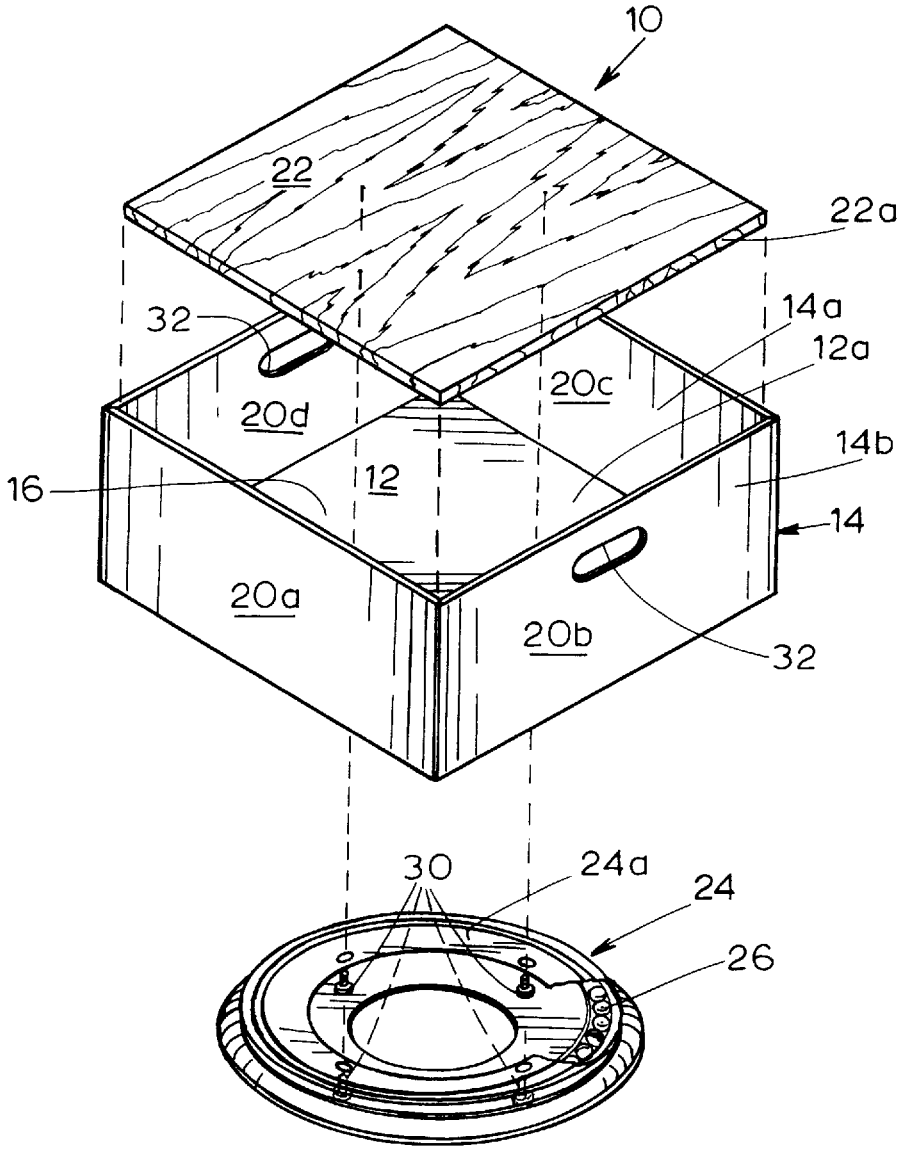
FIG. 4 is an exploded perspective view of a rotary corrugated box in accordance with the present invention.

As will be appreciated from FIG. 4, a rigid plywood insert 22 is provided within the box-like enclosure 16 so as to be substantially coextensive with the inner surface 12*a* of the corrugated base 12. The rigid plywood insert 22 is substantially planar and has a flat surface in engagement with substantially all of the inner surface 12*a* of the corrugated base 12. Further, the rigid plywood insert 22 has an outer peripheral edge 22*a* which, by properly sizing the insert 22, may be in engagement substantially entirely about the inner surface 14*a* of the side wall 14.

Figure 3:
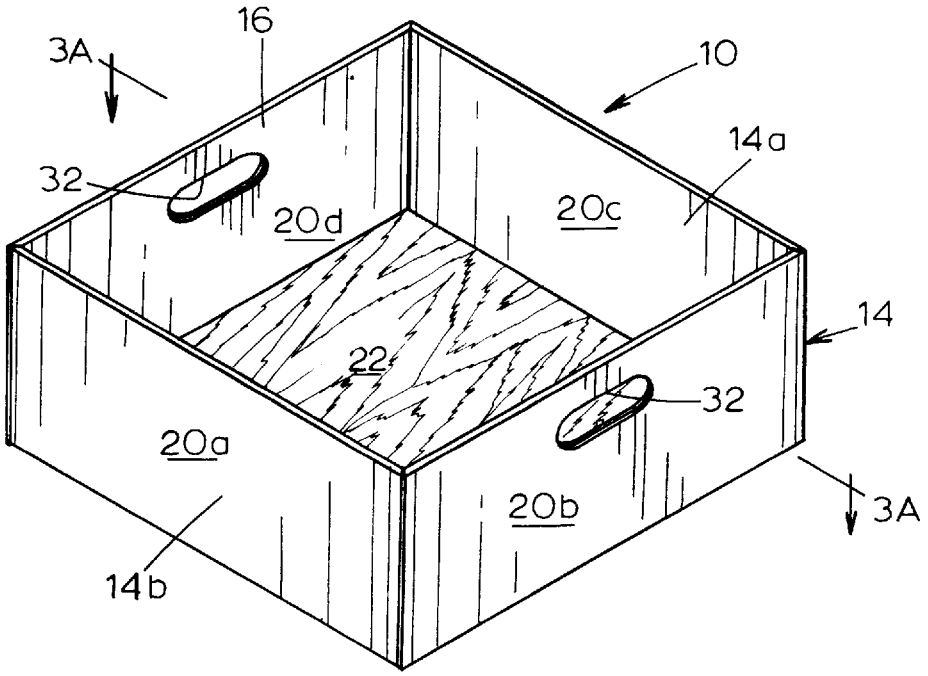
FIG. 3 is a top perspective view, with contents removed, similar to FIG. 1.
Figure 3A:
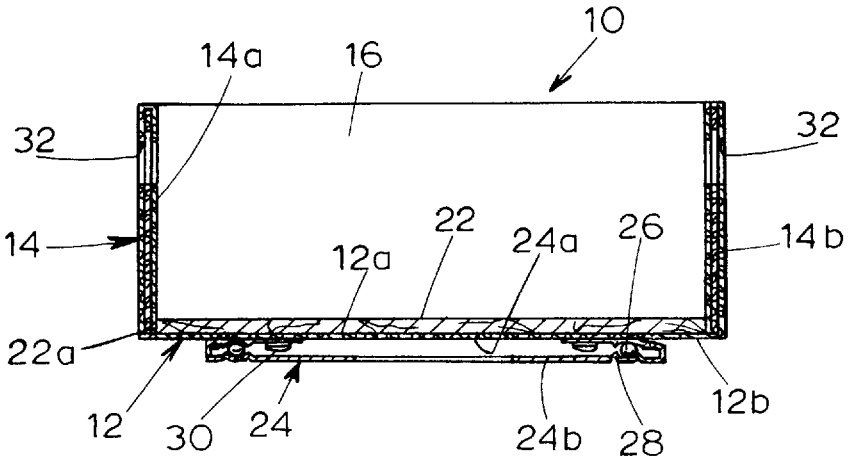
FIG. 3A is a cross-sectional view taken generally along the line 3A—3A of FIG. 3.

As best shown in FIGS. 3A and 4, the rotary corrugated box 10 includes a rotary base assembly generally designated 24 having a first portion 24*a* in engagement with the outer surface 12*b* of the corrugated base 12. The rotary base assembly 24 also has a second portion 24*b* which is suitable adapted to be disposed on a supporting surface such as a table or desk for the rotary corrugated box 10. Still further, the rotary base assembly 24 will be understood to include suitable means for facilitating relative rotational movement between the first and second portions 24*a* and 24*b* thereof.

In this connection, the first and second portions 24*a* and 24*b* of the rotary base assembly 24 are preferably each formed of metal to provide the requisite strength for this highly functional component and, additionally, the means for facilitating relative rotational movement advantageously comprises a plurality of ball bearings 26 disposed in a raceway 28 within one or both of the first and second portions 24*a* and 24*b*.

Still referring to FIG. 4, the rotary corrugated box 10 includes a plurality of screws 30 for rigidly securing the first portion 24*a* of the rotary base assembly 24 to the rigid plywood insert 22 through the corrugated base 12. This essentially forms a sandwich construction consisting of the rigid plywood insert 22 and the first portion 24*a* of the rotary base assembly 24 with the corrugated base 12 disposed therebetween. With this sandwich construction, the rigid plywood insert 22 makes for a rigid securement of the rotary base assembly 24 to the rotary corrugated box 10 and also accommodates positioning substantial weight within the rotary corrugated box 10.

Figure 5:
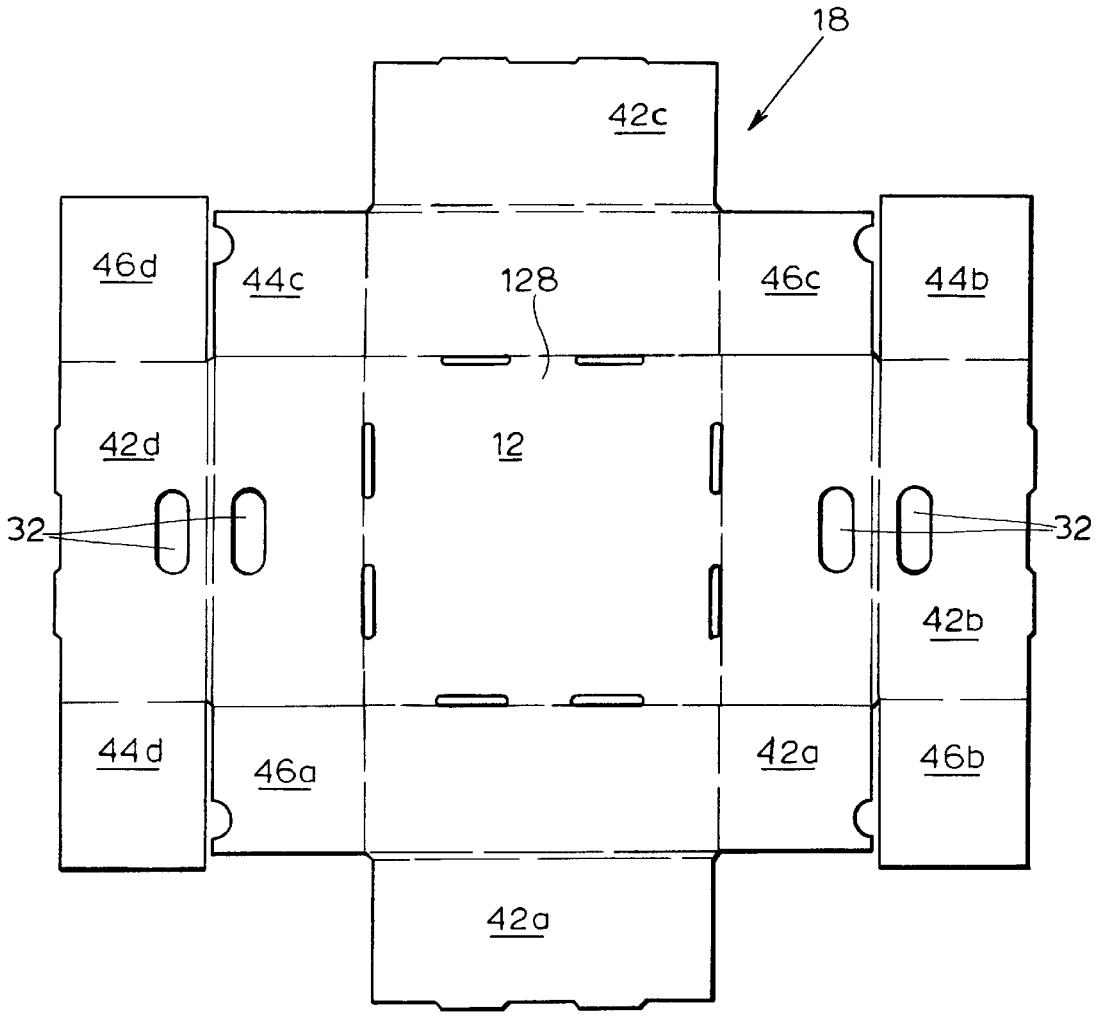
FIG. 5 is a plan view of a single sheet of corrugated material for forming the corrugated box.

Referring to FIGS. 1 and 5, the rotary corrugated box 10 may include an elongated cutout 32 in each of an opposed pair of the side wall portions such as 20*b* and 20*d* for hand lifting the box 10. It is also advantageous for many applications for there to be at least one upstanding corrugated divider 34 within the box-like enclosure 16 to form compartments such as 36, 38 and 40 therein. By subdividing the box-like enclosure 16 to form a plurality of compartments in this manner, the rotary corrugated box 10 is well suited for applications such as educational kits and the like.

As will be appreciated from FIG. 5, the double thickness of each of the side wall portions 20*a*, 20*b*, 20*c*, 20*d* is defined by an inwardly folded side wall portion 42*a*, 42*b*, 42*c*, 42*d*, respectively. There will also suitably be tuck-in flaps 44*a*, 44*b*, 44*c*, 44*d* and 46*a*, 46*b*, 46*c*, 46*d* that are disposed between inner and outer side wall portions of the side walls 14 as will be appreciated by those skilled in the art. Still additional details of the single sheet of corrugated material 18 which is illustrated in FIG. 5 and the manner of assembling the corrugated box 10 will be apparent from the foregoing.

While in the foregoing there has been set forth a preferred embodiment of the invention, it will be appreciated that the details herein given may be varied by those skilled in the art without departing from the true spirit and scope of the appended claims.

What is claimed is:

1. A rotary corrugated box, comprising:

a corrugated base having an upstanding corrugated side wall to define a box-like enclosure, said corrugated base and said corrugated side wall each having an inner surface and an outer surface, said corrugated base and said corrugated side wall being formed of a single sheet of corrugated material;

a rigid insert within said box-like enclosure substantially coextensive with said inner surface of said corrugated base, said rigid insert being substantially planar and having a flat surface in engagement with substantially all of said inner surface of said corrugated base, said rigid insert having an outer peripheral edge in engagement with substantially all of said inner surface of said side wall;

a rotary base assembly including a first portion in engagement with said outer surface of said corrugated base, a second portion to be disposed on a supporting surface for said box-like enclosure, and means for facilitating relative rotational movement between said first and second portions; and means for rigidly securing said first portion of said rotary base assembly to said rigid insert through said corrugated base to form a sandwich construction consisting of said rigid insert and said first portion of said rotary base assembly with said corrugated base therebetween.

2. The rotary corrugated box of claim 1 wherein said corrugated base is rectangular said corrugated side wall includes four side wall portions.

3. The rotary corrugated box of claim 1 wherein said corrugated side wall is formed to have a double thickness of said corrugated sheet material.

4. The rotary corrugated box of claim 1 wherein said rigid insert comprises plywood and said securing means comprises a plurality of screws.

5. The rotary corrugated box of claim 1 wherein said first and second portions of said rotary base assembly are each formed of metal.

6. The rotary corrugated box of claim 1 wherein said means for facilitating relative rotational movement comprises a plurality of ball bearings.

7. A rotary corrugated box, comprising:

a corrugated base having an upstanding corrugated side wall to define a box-like enclosure, said corrugated base and said corrugated side wall each having an inner surface and an outer surface, said corrugated base and said corrugated side wall being formed of a single sheet of corrugated material;

a rigid plywood insert within said box-like enclosure substantially coextensive with said inner surface of said corrugated base, said rigid plywood insert being substantially planar and having a flat surface in engagement with substantially all of said inner surface of said corrugated base, said rigid plywood insert having an outer peripheral edge in engagement with substantially all of said inner surface of said side wall;

a metal rotary base assembly including a first portion in engagement with said outer surface of said corrugated base, a second portion to be disposed on a supporting surface for said box-like enclosure, and a plurality of ball bearings between said first and second portions for facilitating relative rotational movement therebetween; and a plurality of screws rigidly securing said first portion of said rotary base assembly to said rigid plywood insert through said corrugated base to form a sandwich construction consisting of said rigid plywood insert and said first portion of said rotary base assembly with said corrugated base therebetween.

8. The rotary corrugated box box of claim 7 wherein said corrugated base is rectangular said corrugated side wall includes four side wall portions.

9. The rotary corrugated box of claim 7 wherein said corrugated side wall is formed to have a double thickness of said corrugated sheet material.

10. The rotary corrugated box of claim 7 including an opposed pair of elongated cutouts in said corrugated side wall for hand lifting said box.

11. The rotary corrugated box of claim 7 including at least one upstanding corrugated divider within said box-like enclosure to form compartments therein.

12. The rotary corrugated box of claim 7 wherein said double thickness of said corrugated side wall is defined by an inwardly folded wall portion.

13. The rotary corrugated box of claim 12 wherein said inwardly folded wall portion has a free edge in engagement with an upper surface of said rigid plywood insert.

14. A rotary corrugated box, comprising:

a square corrugated base having an upstanding corrugated side wall to define a box-like enclosure, said corrugated base and said corrugated side wall each having an inner surface and an outer surface, said corrugated base and said corrugated side wall being formed of a single sheet of corrugated material, said corrugated side wall being defined by four side wall portions each having a double thickness of said corrugated sheet material;

a rigid plywood insert within said box-like enclosure substantially coextensive with said inner surface of said corrugated base, said rigid plywood insert being substantially planar and having a flat surface in engagement with substantially all of said inner surface of said corrugated base, said rigid plywood insert having an outer peripheral edge in engagement with substantially all of said inner surface of said side wall;

a rotary base assembly including a first portion in engagement with said outer surface of said corrugated base, a second portion to be disposed on a supporting surface for said box-like enclosure, and means for facilitating relative rotational movement between said first and second portions; and a plurality of screws rigidly securing said first portion of said rotary base assembly to said rigid plywood insert through said corrugated base to form a sandwich construction consisting of said rigid plywood insert and said first portion of said rotary base assembly with said corrugated base therebetween.

15. The rotary corrugated box of claim 14 wherein said first and second portions of said rotary base assembly are each formed of metal.

16. The rotary corrugated box of claim 14 wherein said means for facilitating relative rotational movement comprises a plurality of ball bearings.

17. The rotary corrugated box of claim 14 including an elongated cutout in each of an opposed pair of said side wall portions for hand lifting said box.

18. The rotary corrugated box of claim 14 including at least one upstanding corrugated divider within said box-like enclosure to form compartments therein.

19. The rotary corrugated box of claim 14 wherein said double thickness of each of said side wall portions is defined by an inwardly folded side wall portion.

20. The rotary corrugated box of claim 19 wherein said inwardly folded side wall portions each have a free edge engaging an upper surface of said rigid plywood insert.

* * * * *